United States Patent [19]

Reichel et al.

[11] Patent Number: 4,862,435

[45] Date of Patent: Aug. 29, 1989

[54] COMBINATION BRACELET AND WRISTWATCH

[75] Inventors: Judith Reichel, Southbury, Conn.; Kristin M. Olsen, Oslo, Norway

[73] Assignee: Timex Corporation, Middlebury, Conn.

[21] Appl. No.: 212,742

[22] Filed: Jun. 15, 1988

[51] Int. Cl.[4] ..... G04B 37/00; A44C 5/14

[52] U.S. Cl. ..... 368/282; 224/167

[58] Field of Search ..... 368/281–282, 368/301, 309; 224/164, 167–169; 63/1 R, 10, 21

[56] References Cited

U.S. PATENT DOCUMENTS

| | | | |
|---|---|---|---|
| 1,130,405 | 3/1915 | Jeffery et al. | 224/167 |
| 1,139,416 | 5/1915 | Hathaway | 224/167 |
| 1,160,616 | 11/1915 | Jeffery | 224/167 |
| 1,162,480 | 11/1915 | Hathaway | 224/167 |
| 4,493,561 | 1/1985 | Bouchet | 368/281 |

FOREIGN PATENT DOCUMENTS

| | | | |
|---|---|---|---|
| 437220 | 4/1912 | France | 224/167 |
| 7902771 | 8/1969 | France . | |
| 138929 | 6/1930 | Switzerland . | |
| 188661 | 4/1937 | Switzerland | 368/285 |
| 11781 | of 1914 | United Kingdom | 224/167 |
| 22845 | of 1914 | United Kingdom | 224/167 |

*Primary Examiner*—Vit W. Miska

*Attorney, Agent, or Firm*—William C. Crutcher

[57] ABSTRACT

An improved combination bracelet and wristwatch comprising a watch case including a bezel, a crystal, and a case back, the watch case containing a movement, dial and hands disposed therein, said hands being viewable from one side of the case through the crystal, the case back defining a recessed well facing the exterior side and having a decorative insert disposed in said well, a pair of opposed spindles projecting from opposite sides of the bezel, a bracelet attachment including articulated chain elements, and means attached between selected chain elements and said spindles for rotatably and pivotally mounting said watch case on said bracelet attachment.

In a preferred embodiment of the invention, the means rotatably mounting the watch case comprising a pair of collars disposed on said spindles and having a pair of hooks each extending through an articulated chain element and having opposed ends pivotally cooperating with said collars.

6 Claims, 3 Drawing Sheets

COMBINATION BRACELET AND WRISTWATCH

BACKGROUND OF THE INVENTION

This invention relates generally to a timepiece which may easily be converted to a bracelet. More particularly, the invention relates to a fashionable wristwatch which is easily reversible to permit converting it to a bracelet which is strictly for adornment.

Wristwatches have long been designed as jewelry items for adornment of the wrist as well as for their functional timekeeping capability. However, there may be times when adornment is the paramount consideration and it is desired to exhibit a decorative design, precious stones or the like, rather than the face of a timepiece.

Reversible wristwatches are known in the prior art. One such reversible wristwatch is disclosed in Swiss Pat. No. 138929 - Schierwater published June 2, 1930 in which a watch case is rotatable about two diametrically opposed pins by means of a strap attachment connected to a collar. This permits protection of the crystal while engaged in sports. However, since the strap attachment conforms to the curvature of the watch, either a spring or an expansion band is provided to give necessary slack to rotate the watch. The patent refers to a caseback which may be ornamental, fitted with a medallion, or having a coat of enamel carrying a decorative motif on the surface of the caseback.

Another such reversible wristwatch is disclosed in U.S. Pat. No. 4,493,561, issued Jan. 15, 1985 Bouchet, in which the watch case is rotatably mounted its 6 o'clock—noon axis on two bars perpendicular to the axis, each of the bars being attached to respective opposite ends of a watch strap. Although this wristwatch is primarily intended for two movements and/or two opposed dials each viewable through crystals on opposite sides of the bezel, it suggests that the case might contain only one movement which would be visible from one side of the case only, the other side or bottom of the case being provided with precious or semi-precious stones.

Still another reversible watch with a decorative back such as an engraved monogram, but with attachment suitable for a leather strap, is shown in French patent application 79 02771 filed Feb. 2, 1979 and published as No. 1 447 692 on Aug. 29, 1980.

The foregoing patents are intended for straps or bands and are not easily adapted to a ladies' wristwatch having a bracelet with articulated chain elements.

It would be desirable to have a very simple construction for reversing the bezel which is adaptable to a articulated chain and clasp attachment, thereby enhancing its suitability as an article of jewelry.

It would also be desirable to provide a reversible wristwatch using a bezel which is adapted for a conventional case back and having a simple construction for substituting a decorative caseback.

Accordingly, one object of the present invention is to provide a combination wristwatch and bracelet with a simple attachment for rotatably mounting and reversing the wristwatch case.

Another object of the invention is to provide an improved case back for holding a decorative insert for such a wristwatch.

Still another object is to provide an improved rotatable bezel suitable for attachment to articulated chain elements of a bracelet.

DRAWINGS

The invention, both as to organization and method of practice, together with further objects and advantages thereof, will best be understood with reference to the following description taken in connection with the accompanying drawings, in which:

FIG. 1 is a plan view of a improved combination bracelet and wristwatch with the timekeeping side exposed, FIG. 2 is a view of the same article with the case back and decorative insert exposed, FIG. 3 is an enlarged view, partly in section, showing details of a preferred embodiment of the rotatable attachment, FIG. 4 is a cross-sectional view taken along lines IV—IV of FIG. 3, FIG. 5 is an enlarged elevation cross-sectional view the watch case, and FIG. 6 is an enlarged elevation cross-section of a modified form of the invention.

SUMMARY OF THE INVENTION

Briefly stated, the invention comprises an improved combination bracelet and wristwatch comprising a watch case including a bezel, a crystal, and a case back, the watch case containing a movement, dial and hands disposed therein, said hands being viewable from one side of the case through the crystal, the case back having a recessed well facing the exterior side thereof and having a decorative insert disposed in said well, a pair of opposed spindles projecting from opposite sides of the bezel, a bracelet attachment including articulated chain elements, and universal connectors attached between selected chain elements and the spindles for rotatably and pivotably mounting the watch case on said bracelet attachment.

In a preferred embodiment of the invention, the universal connectors comprise a pair of collars rotatably disposed on said spindles and having a pair of hooks each extending through an articulated chain element and having opposed ends pivotably cooperating with said collars.

DESCRIPTION OF THE PREFERRED EMBODIMENT

Figure 1:
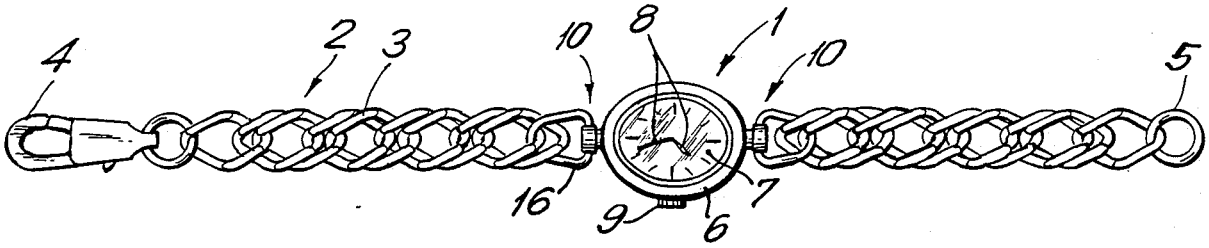

Referring to FIG. 1 of the drawing, a ladies' wristwatch case 1 is fitted with a bracelet attachment 2 of articulated chain elements 3 having a clasp comprising a hook 4 and eyelet 5. The bracelet shown is a double link chain having pairs of overlapping links engaged with adjacent pairs of links. Other types of chain bracelets, bands with articulated links or flexible bracelets are substitutable. The watch case 1 comprises an oval bezel 6 containing a conventional watch movement, dial 7 and hands 8 which are set with a crown 9. The watch case 1 is connected to bracelet attachment 2 by means of a universal rotatable and pivotable connector 10 which permits the watch case 1 to rotate on a 12 o'clock-6 o'clock axis.

Figure 2:
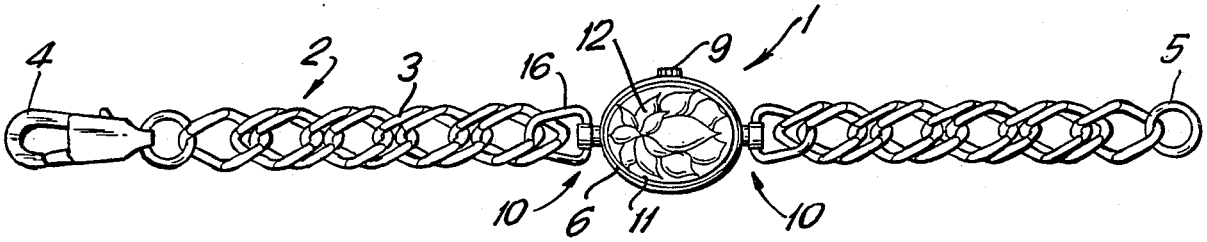

FIG. 2 illustrates the same wristwatch case 1 attached to the same chain bracelet 2, but rotated by means of the universal connectors 10 to provide a decorative bracelet. The bezel back opening of 6 is closed by a case back 11 especially adapted to incorporate a decorative insert 12, which is purely for decoration and has no timekeeping function.

Figure 3:
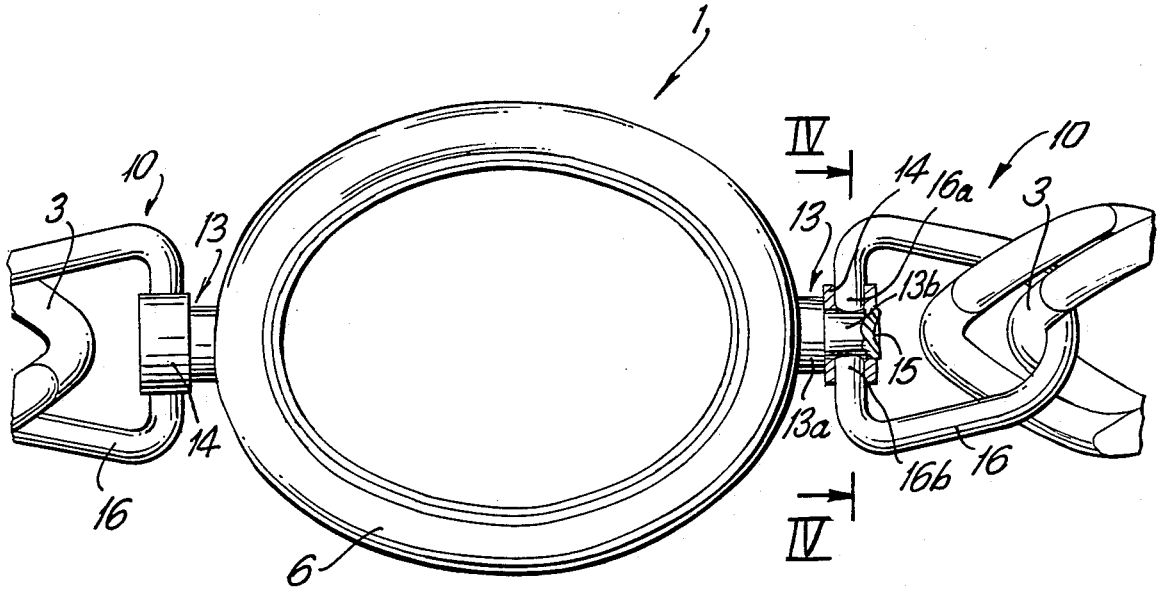

Referring to FIG. 3 of the drawing, the bezel 6 is shown without the movement and enlarged to show the details of a preferred form of universal connector 10. Spindles 13, which may either be integral with bezel 6 or attached by soldering are disposed on the 12 o'clock-6 o'clock axis and comprise a major diameter portion 13*a* and a minor diameter portion 13*b*. Collars 14 are disposed on the minor diameter portions 13*b* to be freely rotatable thereon and retained by riveting or upsetting the end of the minor diameter spindle, as indicated at 15. An open connecting link 16 on either side of the watch case 1 is engaged with a respective articulated bracelet element 3. The connecting link is arranged to be pivotable with respect to the collar 14 by means of opposed inwardly directed, diametrically opposed ends 16*a*, 16*b*.

Figure 4:
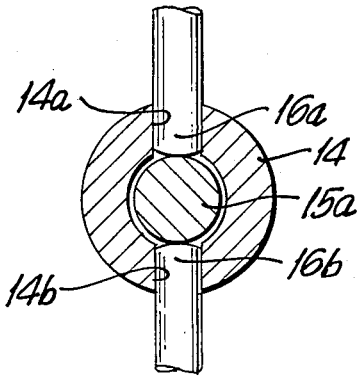

FIG. 4 of the drawing illustrates a cross-section through the collar taken along lines IV—IV. Here the collar 14 is seen to be rotatable with respect to the minor diameter spindle portion 15*a* and is seen to include diametrically opposed holes 14*a*, 14*b* which receive the opposed ends 16*a*, 16*b* of the connecting link 16.

Figure 5:
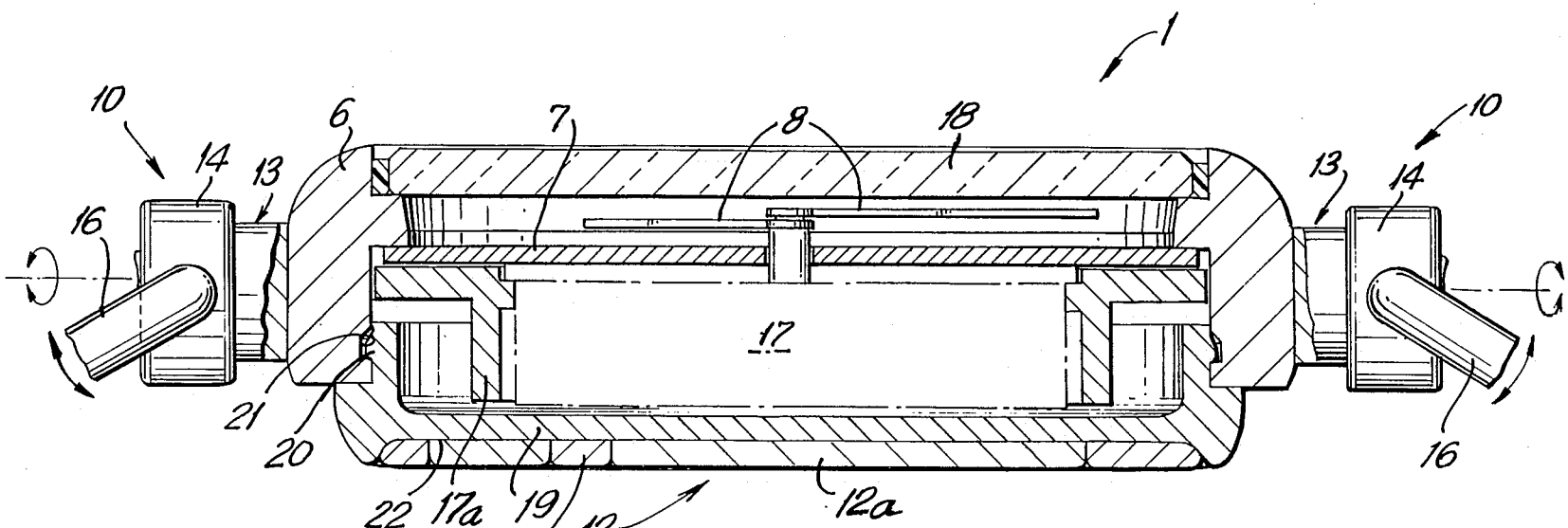

Referring to FIG. 5 of the drawing, a cross-sectional elevation is shown of the bezel 6 with a standard conventional movement 17 held within the bezel on a frame 17*a*. The watch dial 7 and hands 8 are viewable through a crystal 18. An opening at the bottom of the bezel is closed by means of a modified case back 19. The case back includes retaining lugs 20 snapped into a groove 21 in the inner bezel wall.

In accordance with the present invention, case back 19 is contoured, machined or formed to provided a recessed well 22, which receives a decorative insert 12. Decorative insert 12 may comprise one or more painted metal elements 12*a*, 12*b* secured with cement, brazing or the like. Alternatively, the decorative members 12*a*, 12*b* may be precious or semi-precious stones or colored vitreous pieces or any other suitable components providing a decorative insert, the type of insert or design thereon not being material to the present invention.

As indicated, the universal connector 10 provides two motions, collar 14 being rotatable around the axis of spindle 13 and connecting link 16 being pivotable with respect to collar 14.

In operation, the watch case 1 is lifted slightly on the wrist, this being permitted by the pivotable connector link 16, and then is rotated within the collars 14 so that the decorative insert 12 is exposed and the wristwatch is converted into a bracelet. Similar movement converts it back to a timepiece.

Figure 6:
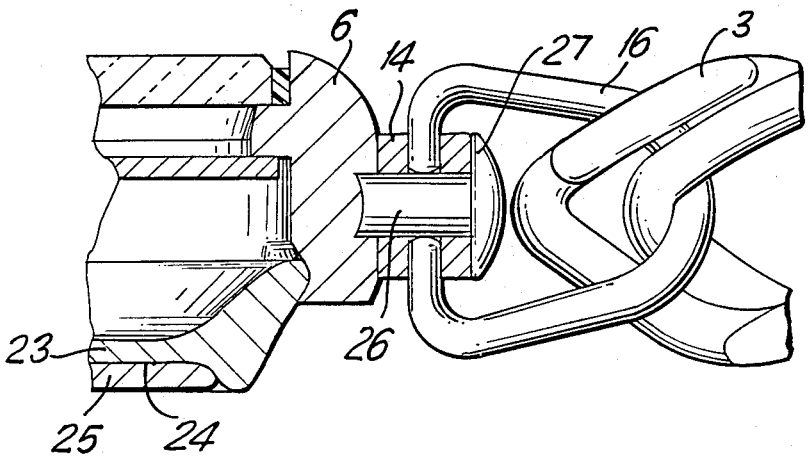

FIG. 6 shows a modified form of the invention with a slightly different type case back and universal connector 10. The case back 23 includes a recessed well 24 with colored stones 25 inlaid into the caseback.

The collar 14 and connecting link 16 are made as previously shown. However, a single diameter spindle 26 is provided with a rounded head 27, having a diameter approximately that of collar 14. Head 27 retains the collar on the spindle 26 which is soldered or otherwise suitably attached in a hole in bezel 6.

While there has been disclosed what has considered to be the preferred embodiment of the invention and a modification thereof, other modifications will be apparent to those skilled in the art, and it is desired to secure in the appended claims all such modifications as fall within the true spirit and scope of the invention.

We claim:

1. A combination bracelet and wristwatch comprising:

a watch case including a bezel, a crystal, and a case back defining an enclosure;

a movement disposed in said enclosure having hands viewable through said crystal;

said case back defining a recessed well on exterior thereof, and having a decorative insert disposed in said well, a pair of spindles extending from opposite ends of said bezel on a 12 o'clock–6 o'clock axis relative to the timepiece hands;

a bracelet attachment including articulated chain elements; and a pair of universal connectors attaching the ends of said bracelet to said spindles and adapted to provide rotation of said watch case about the axis of said spindles and to provide pivoting motion of said bracelet with respect to said spindles, said universal connectors comprising a collar rotatably mounted around said spindle, a connecting link having diametrically opposed ends pivotally mounted in said collar and means retaining said collar on said spindle.

2. The combination according to claim 1, wherein said spindle comprises a major diameter portion attached to said bezel, a minor diameter portion extending therefrom and supporting said collar, said minor diameter portion being upset to provide said collar retaining means.

3. The combination according to claim 1, wherein said spindle is connectible to said bezel and includes a rounded head serving as said collar retaining means.

4. The combination according to claim 1, wherein said decorative insert comprises a plurality of colored stones inlaid into said recessed well of the case back.

5. The combination according to claim 1, wherein said decorative insert comprises one or more painted metallic elements disposed in said recessed ell.

6. The combination according to claim 1, wherein said bezel is oval and wherein said bracelet attachment is a double link chain having hook and eye clasp.

* * * * *